US011077028B2

(12) United States Patent
Rok

(10) Patent No.: US 11,077,028 B2
(45) Date of Patent: Aug. 3, 2021

(54) DEVICE FOR QUICK PREPARATION OF BEVERAGES WITH REGULATED TEMPERATURE

(71) Applicant: INNOVAT PRO d.o.o., Ljubljana (SI)

(72) Inventor: Colaric Rok, Kamnik (SI)

( * ) Notice: Subject to any disclaimer, the term of this patent is extended or adjusted under 35 U.S.C. 154(b) by 159 days.

(21) Appl. No.: 16/611,990

(22) PCT Filed: Apr. 24, 2018

(86) PCT No.: PCT/SI2018/050017

§ 371 (c)(1),
(2) Date: Nov. 8, 2019

(87) PCT Pub. No.: WO2018/208236

PCT Pub. Date: Nov. 15, 2018

(65) Prior Publication Data

US 2020/0405580 A1 Dec. 31, 2020

(30) Foreign Application Priority Data

May 9, 2017 (SI) ..... P-201700127

(51) Int. Cl.
*A47D 15/00* (2006.01)
*A61J 9/00* (2006.01)
*A61J 9/06* (2006.01)

(52) U.S. Cl.
CPC ..... *A61J 9/008* (2013.01); *A61J 9/0615* (2015.05); *A61J 2200/42* (2013.01)

(58) Field of Classification Search
CPC ..... A61J 9/008; A61J 9/0615; A61J 2200/42
See application file for complete search history.

(56) References Cited

U.S. PATENT DOCUMENTS

| | | | | |
|---|---|---|---|---|
| 2,680,441 | A * | 6/1954 | Krammer | A61J 7/0053 604/217 |
| 2,786,769 | A * | 3/1957 | Greenspan | A61J 9/00 426/117 |
| 4,856,995 | A * | 8/1989 | Wagner | A61J 9/00 433/215 |
| 5,433,328 | A | 7/1995 | Baron et al. | |
| 8,459,450 | B1 | 6/2013 | Whitaker et al. | |
| 10,220,361 | B1 * | 3/2019 | Dushine | B01F 13/0854 |
| 2007/0280657 | A1 | 12/2007 | Loia | |

(Continued)

FOREIGN PATENT DOCUMENTS

| | | | |
|---|---|---|---|
| FR | 2931801 | A1 | 12/2009 |
| WO | 20130159287 | A1 | 10/2013 |

*Primary Examiner* — Amy J. Sterling
(74) *Attorney, Agent, or Firm* — McGarry Bair PC

(57) ABSTRACT

A device for preparing a beverage comprises a bottle, which includes the teat, a container, and a heating chamber. The bottle nests within the heating chamber and the container is connected to the neck of the bottle. At the bottom of the heating chamber is a heating element and an electrical circuit and all required elements for heating a bottle in the heating chamber. The heating chamber provides instant or constant heating of fluid in the bottle. Preparation of the beverage may include detaching the bottle from the heating chamber, opening the container to allow powder to drop into the bottle with the fluid, and shaking the bottle to dissolve the powder in the fluid.

9 Claims, 6 Drawing Sheets

(56) References Cited

U.S. PATENT DOCUMENTS

| | | | | |
|---|---|---|---|---|
| 2008/0041807 | A1* | 2/2008 | Tominaga | A61J 9/008 215/11.3 |
| 2010/0072160 | A1 | 3/2010 | Hayes et al. | |
| 2011/0209625 | A1 | 9/2011 | Kang | |
| 2014/0069606 | A1 | 3/2014 | Lee | |
| 2015/0282652 | A1 | 10/2015 | Honarvar et al. | |
| 2015/0283038 | A1 | 10/2015 | Abou-Odah et al. | |
| 2018/0256452 | A1* | 9/2018 | Chen | A61J 9/005 |
| 2020/0237623 | A1* | 7/2020 | De La Rosa | A61J 9/008 |
| 2020/0385184 | A1* | 12/2020 | Stallard | B65D 51/2835 |
| 2021/0085566 | A1* | 3/2021 | Keenan | A61J 11/008 |

* cited by examiner

DEVICE FOR QUICK PREPARATION OF BEVERAGES WITH REGULATED TEMPERATURE

RELATED APPLICATIONS

This application claims the benefit of international application no. PCT/SI2018/050017 filed Apr. 24, 2018 and Slovenian application no. P-201700127 filed May 9, 2017.

BACKGROUND

The subject of the invention is a device for quick preparation of beverages with regulated temperature, primarily adapted milk, with which we can significantly reduce preparation time. The device is primarily intended for night-time feeding of children, but can also be used during day-time. It is suitable for travels and other activities where we have limited access to the electric grid. Nighttime feeding is a problem for many parents, as the child cries loudly to let parents know that he or she is hungry. Children need to be fed several times per night, and if breastfeeding is not possible for any reason, it is necessary to prepare a bottle with adapted milk, which can take a few minutes. A few minutes may not sound much, but if we consider loud yelling of a hungry child, these minutes seem like an eternity. A child's crying can wake household members, resulting in their tiredness, lower work productivity, bad mood, etc. The invention ensures that the device is within reach and that we can prepare adapted milk in less than ten seconds.

The problem solved by this invention is the construction implementation of the device, with which it is possible to prepare adapted milk in less than ten seconds, ensuring ideal adapted milk temperature; furthermore, it is portable, thus suitable for travels, and can be used to prepare other beverages.

Currently, there are several products to help with night-time feeding; however, no product is not explicitly aimed at solving the problems arising from night-time baby feeding.

The first is heating water using a pan and measuring water temperature using a thermometer. Once the water reaches the ideal temperature, it is used for mixing adapted milk in a baby bottle. To prepare adapted milk, it is necessary to get out of bed, heat water, and mix the beverage. The preparation time is assessed at seven minutes.

Some parents use a baby bottle heater, such as the invention under patent application US2007280657 (A1). To prepare adapted milk using a baby bottle heater, it is necessary to get out of bed, prepare adapted milk in a baby bottle, and heat it in a baby bottle heater. The preparation time is assessed at five minutes. There is also a device to prepare adapted milk, such as the invention under patent application US2011209625 (A1), with which adapted milk can be prepared as an instant beverage. Therefore, the device includes a water container, adapted milk container, and a heating element. The baby bottle is placed under the opening, from which a prepared, heated adapted milk is dispensed; then the device is activated. The problem lies primarily in the size of the device, as it is not suitable for being placed on a nightstand. It is thus necessary to get up at night to prepare adapted milk using this device. The preparation time is assessed at three minutes.

Many parents combine multiple tools to prepare adapted milk, including thermo bottle, adapted milk doser, adapted milk spoon, bottle and adapted milk. All these tools are arranged on a nightstand, and when a child cries, parents start preparing adapted milk. In addition to adapted milk often spilling during preparation, which requires additional cleaning, the main problem is ensuring the appropriate water temperature in the thermal bottle. The preparation time is assessed at three minutes.

SUMMARY OF THE INVENTION

In one aspect, a device for preparing a beverage comprising a solution of fluid and powder includes a heating chamber, a bottle sized to nest within the heating chamber and to hold a fluid, a container attached to the bottle and having a chamber configured to hold a powder and selectively deliver the powder to the bottle, and a circuit board mounted in the container. The circuit board includes a heater element on one side in thermal communication with the bottle and an electrical circuit on the other side configured to selectively energize the heater element. When the fluid achieves a set temperature, a user can selectively actuate the container to deliver powder to the heated fluid to prepare the beverage.

DETAILED DESCRIPTION

Figure 1:
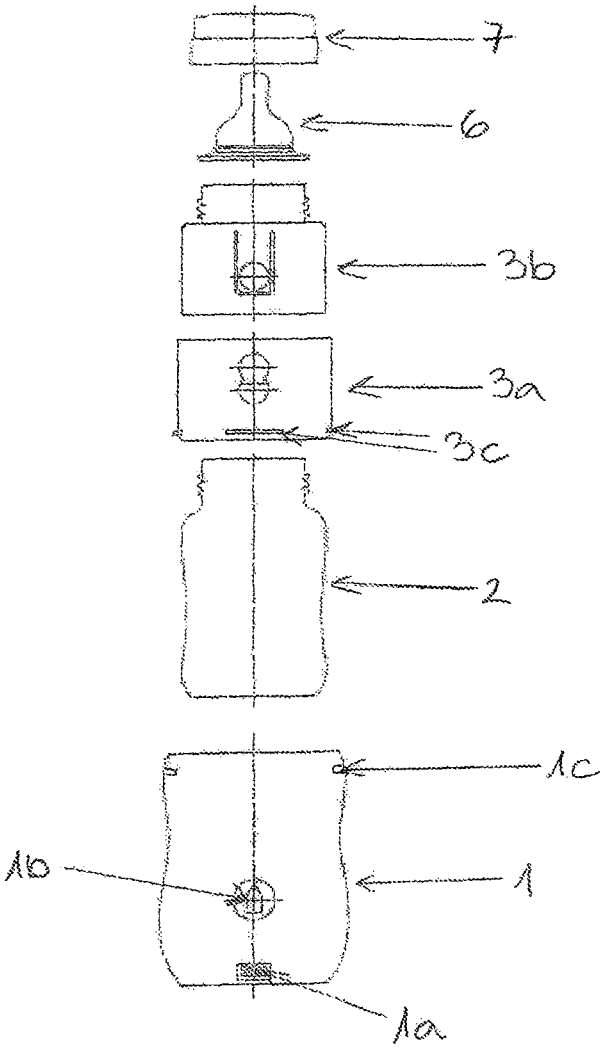
FIG. 1 is an exploded view of aspects of the device.
Figure 2A:
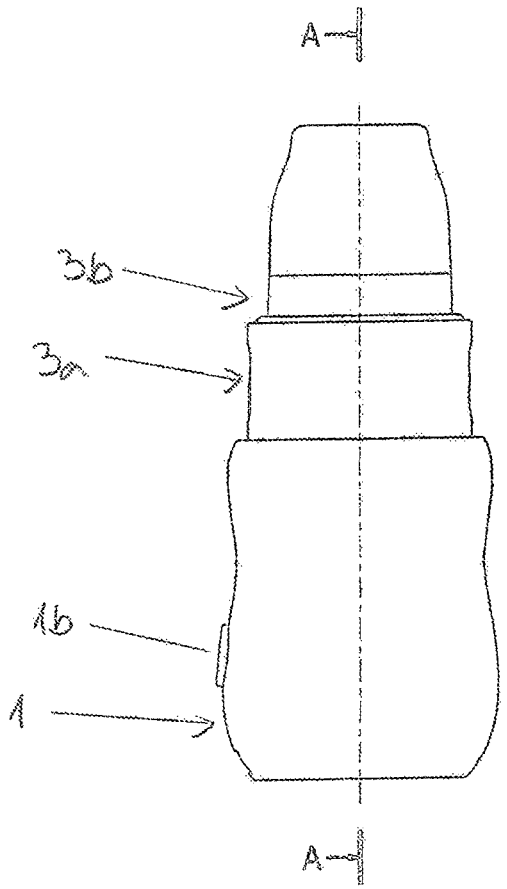
FIG. 2A is a side view of the device of FIG. 1 assembled with the container in a closed position.
Figure 2B:
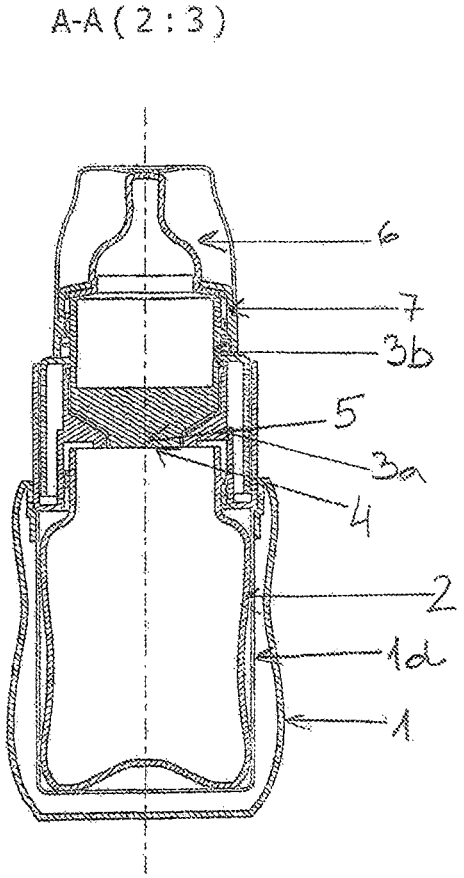
FIG. 2B is a cross sectional view taken along line A-A of FIG. 2A.
Figures 3A, 3B:
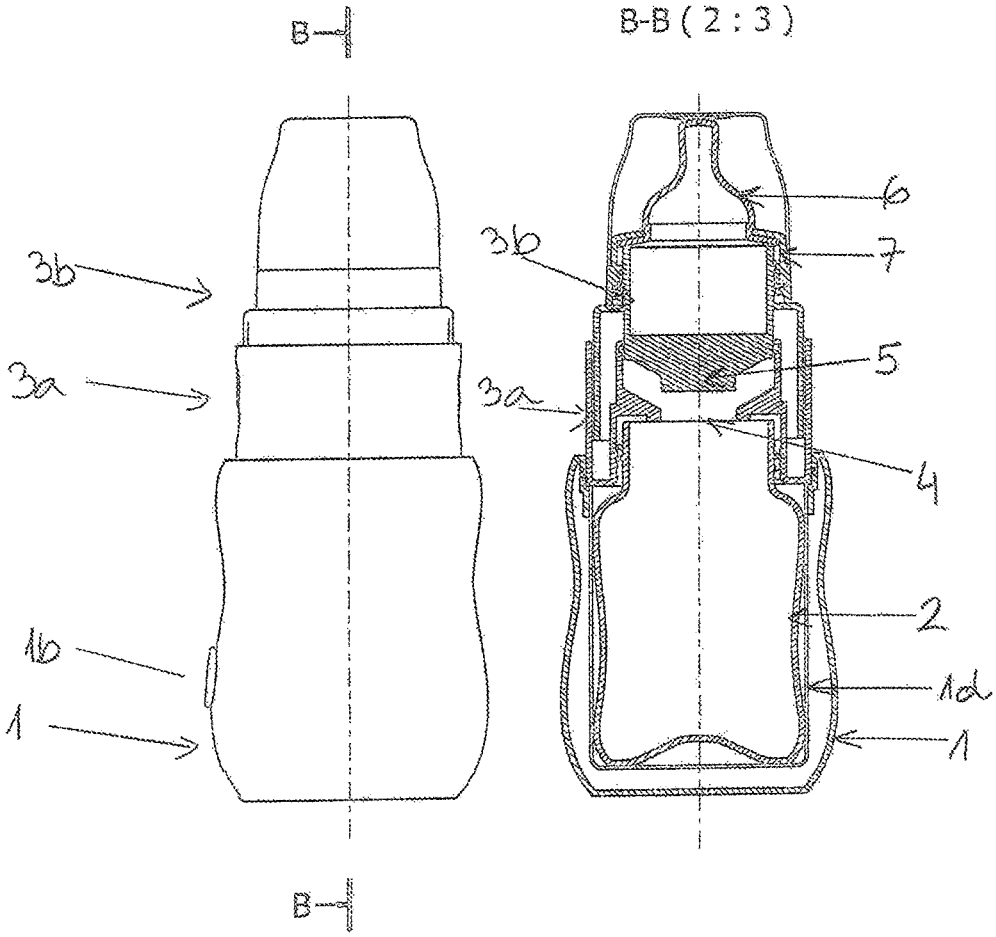
FIG. 3A is a side view of the device of FIG. 1 assembled with the container in an open position.
FIG. 3B is a cross sectional view taken along line B-B of FIG. 3A.

FIGS. 1 to 3 show the device for quick preparation of adapted milk. Device components are made of plastic, rubber, glass, metal, silicone, or any combination thereof, including any other materials that achieve the purposes for which they are employed. The device comprises a heating chamber (1), a bottle (2), a teat or nipple (6), an attachment frame (7) with an internal thread and a container (3). The container (3) comprises a bottom part (3*a*) and a top part (3*b*).

The heating chamber (1) is primarily made from one piece, but can be composed of several components that achieve the same functionality. Optionally, the heating chamber (1) can also include an internal chamber (1*d*). The internal chamber (1*d*) is preferably made of a material with high thermal conductivity, for example a metal such as aluminum. The bottle (2) is sized to nest within the heating chamber (1) or the internal chamber (1*d*). The bottle (2) is made of any thermally conductive material, including plastic or glass. The purpose of the internal chamber (1*d*) and heating chamber (1) with or without the internal chamber (1*d*) is to provide uninterrupted heating of the bottle (2), including any fluid in the bottle. An air-filled space (1*e*) is located between the internal chamber (1*d*) and the heating chamber (1), ensuring some insulation between the internal chamber (1*d*) and heating chamber (1). When the device is assembled, the space (1*e*) in the heating chamber (1) is preferably sealed, since the heating chamber (1) is removably attached to the bottom part (3*a*) of the container (3). The attachment mechanism is implemented using pins (3*c*) at the bottom part (3*a*) of container (3) and appropriate threads (1*c*) on the top part of the heating chamber (1); specifically, the top part of the heating chamber (1) is twisted or pressed to lock, using pins (3*c*) and threads (1*c*), into the bottom part (3*a*) of the container (3). Optionally, there is a seal in the inner section of the bottom part (3*a*) of the container (3) or the inner section of the top part of the heating chamber (1). In this way, an appropriate seal of the inner space of the heating chamber (1) or internal chamber (Id) can be ensured, thus resulting in significantly better heating of the fluid in the bottle (2) and reduced heat loss.

A heating element (1*a*) is disposed at the base of the heating chamber (1) in the space (1*e*), preferably on a circuit board that provides electric circuits and other required elements for operation of the heating chamber (1). A temperature sensor (1*b*) may be positioned 1 to 5 centimeters, or higher, above the bottom of the chamber. Multiple heating element types are possible, such as wire heating elements, induction heating elements, heating foils, and other heating elements with the same function.

The container (3) is equipped with appropriate seals to ensure water-tightness between the bottle (2) and the container (3), as well as within the container (3), i.e. between the bottom part (3*a*) and top part (3*b*) of the container (3). The bottom part (3*a*) of the container (3) includes at least one opening (4), and the top part (3*b*) of the container (3) includes at least one plug (5). The bottom part (3*a*) of the container (3) has at least one opening on the surface that is in contact with the neck of the bottle (2) when assembled, while the top part (3*b*) of the container (3) has at least one plug (5) on the surface that is in contact with the neck of the bottle (2) when assembled, whereby the position and shape of the plug(s) (5) matches the position and shape of the opening(s) (4), so that the plug(s) (5) provide a watertight seal for the opening(s) (4) when the device is assembled. Between the bottom part (3*a*) and top part (3*b*) of the container (3) is a seal, which ensures a watertight closure of the bottom (3*a*) and top part (3*b*) of the container (3).

Using the detachable coupling mechanism, primarily a screwed thread, the bottom part (3*a*) of the container (3) can be attached directly to the neck of the bottle (2). The bottom part (3*a*) of the container (3) and the top part (3*b*) of the container (3) are connected with one of the various known forms of pins and threads, or other forms of attachment, which allow independent twisting or lifting of the top part (3*b*) from the bottom part (3*a*) of the container (3). When twisting or lifting the top part (3*b*) from the bottom part (3*a*) of the container (3), the plug(s) (5) move away from the opening(s) (4), thus opening them and allowing the substance in the container (3) to drop into the bottle (2).

On the upper side of the top part (3*b*) of the container (3), the teat (6) is attached with the attachment frame (7), providing a seal between the top part (3*b*) of the container (3) and the teat (6). Optionally, additional seals are inserted between the top part (3*b*) of the container (3) and the teat (6). FIG. 2 shows the front view of the bottle (2) with the milk container (3) in the closed state. Plug (5) in the top part (3*b*) of the container (3) is used to close the opening (4) in the bottom part (3*a*) of the container (3).

FIG. 3 shows a side view of the bottle (2) with the milk container (3) in the open state. By lifting or pulling the top part (3*b*) of the container (3) up, the plug (5) in the top part (3*b*) of the container (3) lifts and opens the opening (4) in the bottom part (3*a*) of the container (3).

Figure 5:
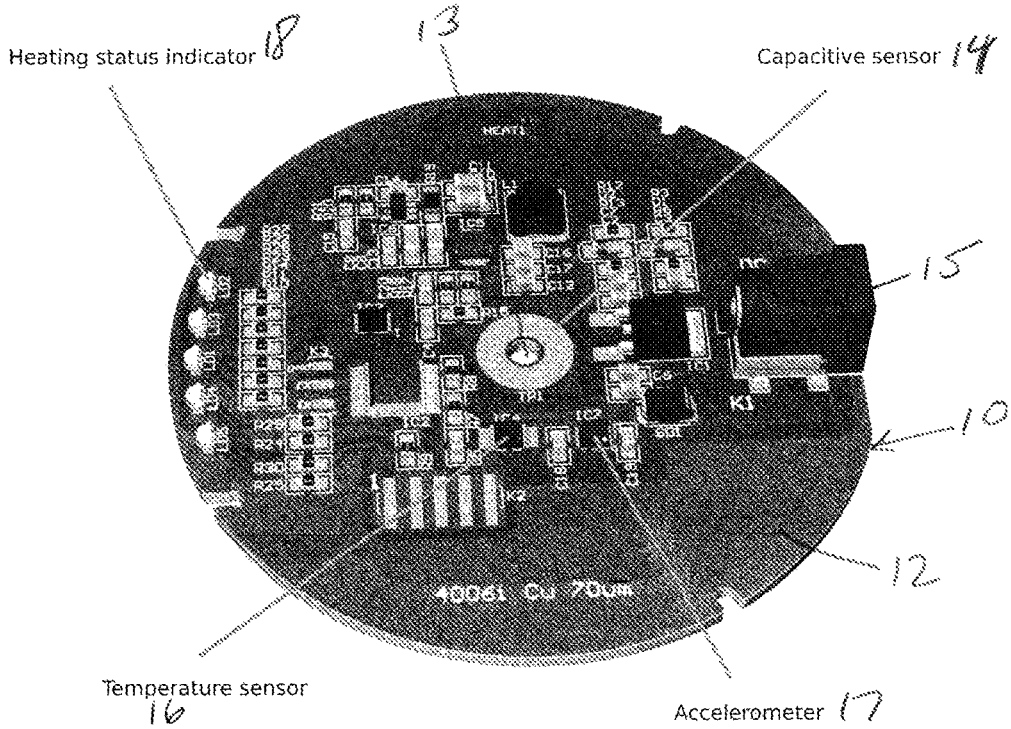
FIG. 5 is an isometric view of the lower surface of the circuit board.
Figure 4:
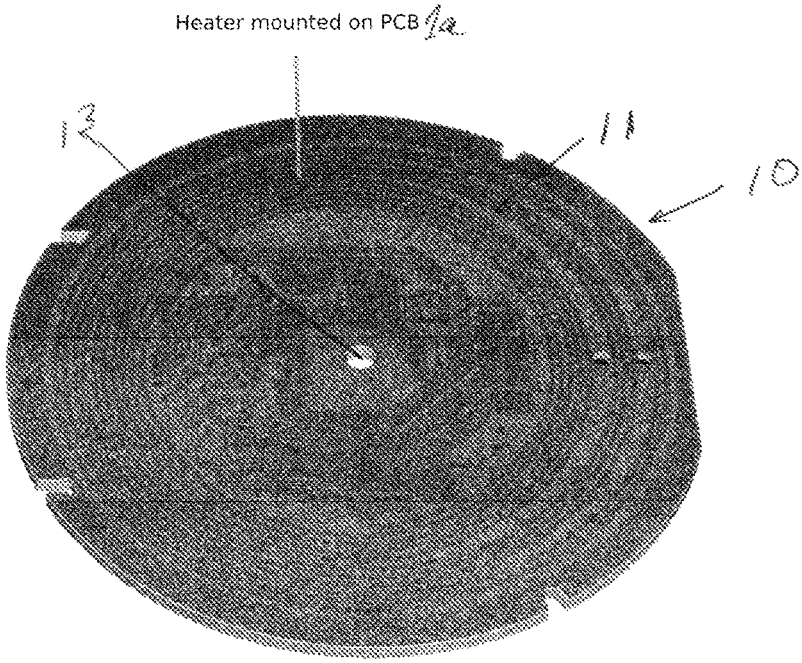
FIG. 4 is an isometric view of the upper surface of the circuit board.

FIGS. 4 and 5 illustrate a circuit board (10) containing an embodiment of the heater (1*a*). The circuit board (10) has an upper surface (11) containing the heater element (1*a*) and a lower surface (12) containing an electrical circuit. A central hole (13) enables the circuit board (10) to be mounted to a bottom wall of the internal chamber (1*d*) in the space (1*e*) by a thermally conductive fastener. Surrounding the central hole (13) on the lower surface (11) is a capacitive sensor (14). The thermally conductive fastener not only secures the connection between the circuit board (10) and the underside of the internal chamber (1*d*), but it also carries capacitive detection from the capacitive sensor (14) to the upper surface (11) of the internal chamber (1*d*) where the bottle (2) is disposed. The capacitive sensor (14) is configured to detect the presence of water.

Figure 7:
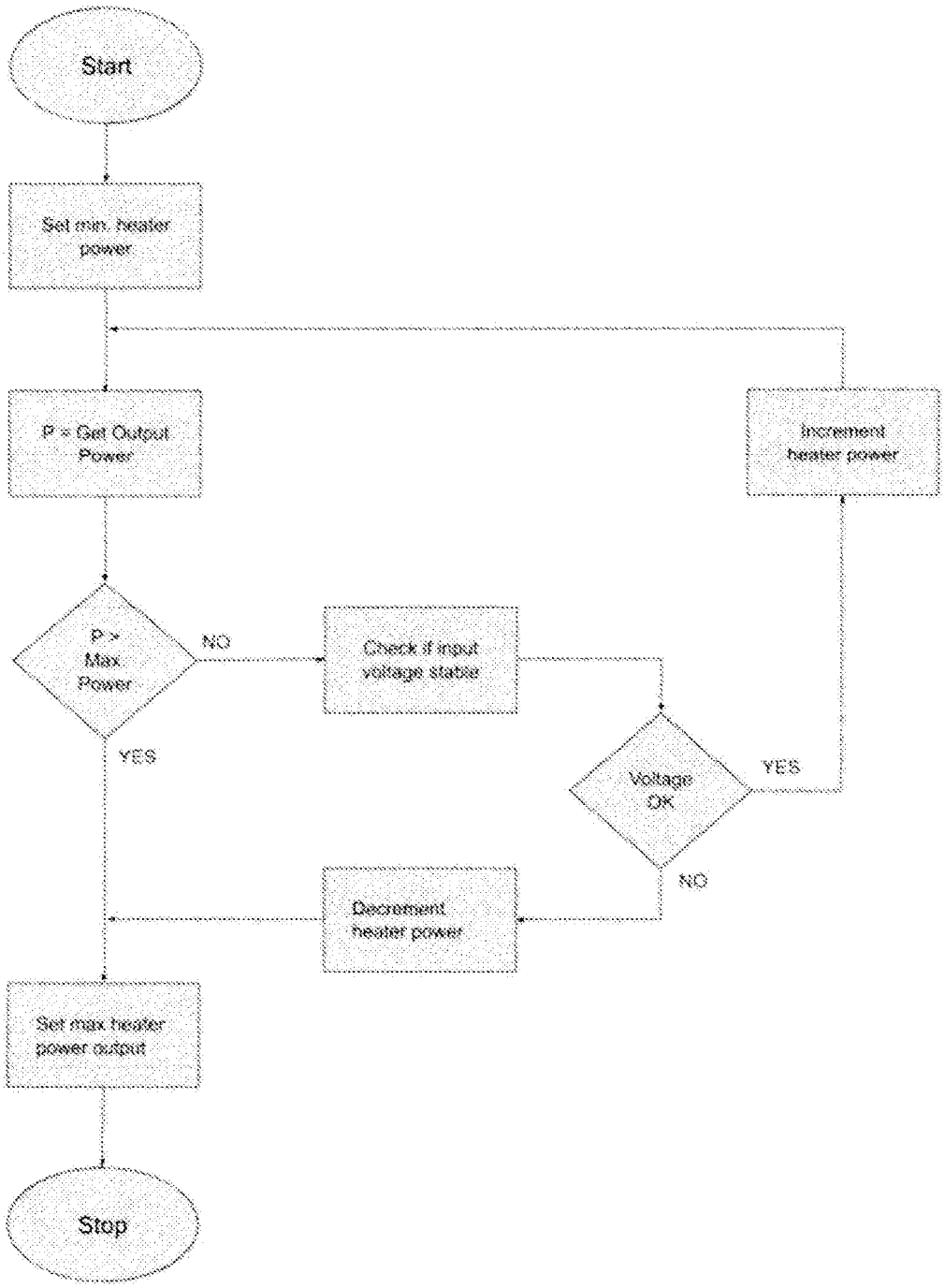
FIG. 7 is an example of an algorithm to detect a power source.

The electrical circuit on the lower surface (12) includes the capacitive sensor (14), a power connector (15), a temperature sensor (16), an accelerometer (17), and a heating status indicator (18). The electrical circuit is configured to detect different types of power sources connected to the power connector (15) to determine how much power can be consumed from the power source. FIG. 7 illustrates a sample algorithm that can be used by the electrical circuit to detect the power source. Maximum power consumption is preferably 24 W. Supply voltage is minimum 5V and maximum 15V. Types of supported power sources include a 5V USB power supply adapter whit a maximum power of 10 W and a 12V wall or car plug adapter with a maximum power of 24 W.

Figure 6:
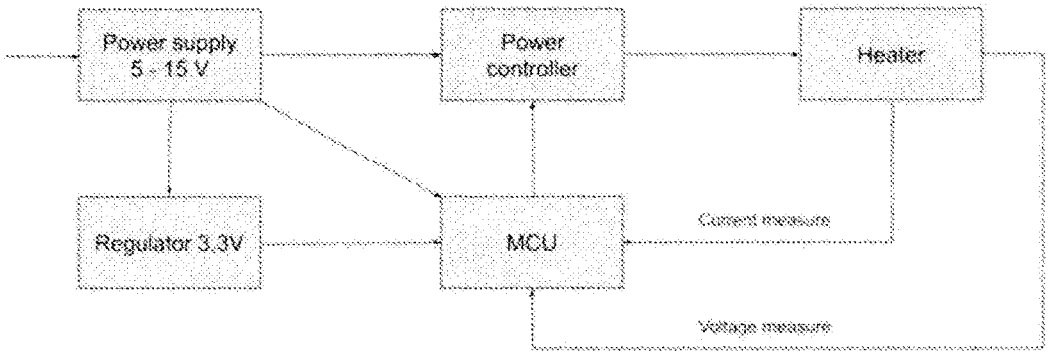
FIG. 6 is a schematic diagram of the circuit for the heater element.

The temperature of the fluid in the bottle (2) is determined by the temperature sensor (14). Temperature sensor (14) measures how much the current water temperature is, and an algorithm then decides how much heating is required to heat the fluid to 37° C./310.15 K. When the set temperature is reached, the heater maintains the fluid temperature at 37° C./310.15 K for 10 hours. The heater element (1*a*) maintains the temperature by cyclic heating. After every heating cycle there is a measure cycle. The more the measured temperature deviates from the desired temperature, the greater the heating cycle is. When the water reaches the desired temperature, the heating cycles are very small, so there is no significant deviation. The smaller the amount of water is, the greater the deviation is. Deviation range is approximately +−0.5° C. FIG. 6 illustrates a circuit diagram for the heater element.

The heating status indicator (18) is configured to display different states of the device using a plurality of light emitting diodes (LEDs). Preferably the LEDs are visible through the heating chamber (1). States may include initialization, error, bottle detection, time to set temperature, and set temperature reached. For example, the initialization state may be indicated by the LEDs sequentially turning on and off in an orange color. An error state may be indicated by a middle LED blinking red. No bottle detected may be indicated by the middle LED blinking orange. The estimated time to set temperature may be indicated from 5 to 60 minutes in a countdown format such as:

1 ORANGE led—5 min
2 ORANGE leds—10 min
3 ORANGE leds—15 min
4 ORANGE leds—30 min
5 ORANGE leds—60 min The set temperature reached state may be indicated by the middle LED in a steady state green color.

The accelerometer (17) can be utilized to show the estimated time to set temperature. Instead of the LEDs remaining on throughout the time it takes to reach the set temperature, the circuit can be configured to turn off the LEDS while the heater is heating the fluid in the bottle, and turn on the appropriate LEDs when a user shakes the container (1) while heating. The accelerometer (17) will sense the motion and send a signal to turn on the appropriate LEDs. Preferably, the accelerometer (17) will have no effect when displaying other states, such as initialization, error, bottle detection, and set temperature reached.

Device Usage

Water is poured into the bottle (2), and the bottom part (3*a*) of the container (3), which has the opening (4) or several openings on the surface in contact with the neck of the bottle (2), is screwed to the neck of the bottle (2). In the bottom part (3*a*) of the container (3), we place the top part (3*b*) of the container (3), which closes the opening (4) in its lowered state, i.e. the state when the top part (3*b*) of the container (3) is pressed to the bottom part (3*a*) of the container (3), with the plug (5) or plugs on the surface in contact with the neck of the bottle (2) when the device is assembled. The required quantity of adapted milk powder is placed into the container (3), and the teat (6) with the attachment frame (7) is attached to the upper side of the top part (3*b*) of the container (3). The device can be plugged in to a power source, and then the assembled bottle (2) is attached to the heating chamber (1) using pins (3*c*) and appropriate threads (1*c*). Alternatively, it is contemplated that the assembled bottle (2) is attached to the heating chamber (1) using the pins (3*c*) and threads (1*c*), which is then plugged to a regular power source or USB plug. The device is now in stand-by. The heating chamber (1) heats or maintains the pre-set water temperature in the bottle (2), while the adapted milk is separate in the container (3) and ready to be mixed. Adapted milk is best mixed before feeding, otherwise it loses its nutritional value. Once a child indicates that they are hungry, the bottle (2) is taken out of the heating chamber (1), the top part (3*b*) of the container (3) is lifted or twisted, thus making an opening through which the adapted milk from the container (3) is poured into the heated water in the bottle (2); the bottle (2) with the adapted milk is then shaken to dissolve the adapted milk; finally, the child can be fed.

The invention claimed is:

1. A device for preparing a beverage comprising a solution of fluid and powder, the device comprising a heating chamber, a bottle sized to nest within the heating chamber and to hold a fluid, a container attached to the bottle and having a chamber configured to hold a powder and selectively deliver the powder to the bottle, and a circuit board mounted in the container, the circuit board including a heater element on one side in thermal communication with the bottle and an electrical circuit on the other side configured to selectively energize the heater element, wherein when the fluid achieves a set temperature, a user can selectively actuate the container to deliver powder to the heated fluid to prepare the beverage.

2. The device according to claim 1 wherein the container includes an internal chamber adapted to receive the bottle.

3. The device according to claim 2 wherein the internal chamber is formed of a thermally conductive material.

4. The device according to claim 3 wherein the thermally conductive material is aluminum.

5. The device according to claim 1 wherein the circuit board includes a capacitive sensor configured to detect the presence of water.

6. The device according to claim 1 wherein the circuit board includes an electrical circuit configured to detect different types of power sources connected to a power connector n teh circuit board.

7. The device according to claim 1 wherein the circuit board includes a temperature sensor to measure a temperature of fluid in the bottle.

8. The device according to claim 1 wherein the circuit board includes a heating status indicator configured to display different states of the device using a plurality of light emitting diodes.

9. The device according to claim 8 wherein the circuit board includes an accelerometer that signals the heating status indicator to display at least one state of the device in response to motion of the device.

* * * * *